US008365652B2

(12) United States Patent
Ehre

(10) Patent No.: US 8,365,652 B2
(45) Date of Patent: Feb. 5, 2013

(54) ADJUSTING ELEMENT

(75) Inventor: Thomas Ehre, Koblenz (DE)

(73) Assignee: Stabilus GmbH, Koblenz (DE)

( * ) Notice: Subject to any disclaimer, the term of this patent is extended or adjusted under 35 U.S.C. 154(b) by 819 days.

(21) Appl. No.: 12/533,203

(22) Filed: Jul. 31, 2009

(65) Prior Publication Data

US 2010/0024638 A1 Feb. 4, 2010

(30) Foreign Application Priority Data

Aug. 1, 2008 (DE) ..... 10 2008 035 971

(51) Int. Cl.
*F15B 15/28* (2006.01)
*F15B 15/20* (2006.01)

(52) U.S. Cl. ..... 92/5 R; 92/53; 91/1; 91/362; 91/389

(58) Field of Classification Search ..... 91/1, 362, 91/389; 92/5 R, 51, 53, 59, 60.5
See application file for complete search history.

(56) References Cited

U.S. PATENT DOCUMENTS 4,751,867 A * 6/1988 Johansson et al. ..... 92/5 R
5,031,504 A * 7/1991 Gratzmuller ..... 91/1
5,233,293 A * 8/1993 Huang et al. ..... 324/207.15
7,250,753 B2 * 7/2007 Terasaki ..... 324/207.24
7,392,736 B2 * 7/2008 Fenn et al. ..... 92/51

FOREIGN PATENT DOCUMENTS

| | | |
|---|---|---|
| DE | 6752056 | 3/1969 |
| DE | G 84 35 666.9 | 1/1985 |
| DE | G 91 04 532.0 | 6/1991 |
| DE | G 91 10 208.1 | 12/1992 |

* cited by examiner

*Primary Examiner* — Thomas E Lazo
*Assistant Examiner* — Logan Kraft
(74) *Attorney, Agent, or Firm* — Cozen O'Connor

(57) ABSTRACT

An adjusting element with a closed first end, a cylinder, a piston displaceably arranged in the cylinder that divides the cylinder into a first work space remote of the first end and a second work space in proximity to the first end, and a piston rod which is arranged at one side of the piston and which projects through the first work space and is guided out of the cylinder concentric to or center longitudinal axis of the cylinder at a second end opposite from the first end so as to be sealed by a guiding and sealing device. The adjusting element has a device for detecting the piston rod position and/or the extended length of the adjusting element. The device for detecting the piston rod position includes a microswitch arranged at the cylinder and at least one switching element cooperating with the microswitch.

8 Claims, 4 Drawing Sheets

ADJUSTING ELEMENT

BACKGROUND OF THE INVENTION

1. Field of the Invention

The invention is directed to an adjusting element with a closed first end, a cylinder, a piston arranged in the cylinder so as to be displaceable and dividing the cylinder into a first work space remote of the first end and a second work space in proximity to the first end, and a piston rod arranged at one side of the piston and projecting through the first work space, the piston rod being guided out of the cylinder concentric to a center longitudinal axis of the cylinder at a second end opposite from the first end so as to be sealed by a guiding and sealing device, the adjusting element further having a device for detecting the piston rod position and/or the extended length of the adjusting element.

2. Description of the Related Art

Adjusting elements of the type mentioned above have been known for a long time and are applied in hatches, covers, or hoods of machine parts or of motor vehicles to assist in the convenient automatic or manual opening and closing thereof.

SUMMARY OF THE INVENTION

For the automatic opening and closing of hatches in particular, it can be advantageous that the position of the piston and, therefore, the position of the piston rod relative to the cylinder be detected to carry out certain functions at fixed points along the travel path of the piston-cylinder unit.

Accordingly, it is an object of an invention to provide an adjusting element which carries out the above-mentioned functions through inexpensive measures which economize on installation space.

This object is met in that the device for detecting the piston rod position comprises a microswitch arranged at the cylinder and at least one switching element cooperating with the microswitch.

In a further development, the microswitch is connected to a power supply device or a control device by means of at least one line.

According to one embodiment of the invention, a protective tube is arranged with a first end at the end of the piston rod opposite from the piston, the protective tube rotatably mounted relative to the piston rod and the cylinder.

In an advantageous manner, a first switching element is arranged at the inner wall of the protective tube in proximity to the first end of the protective tube, and a second switching element is arranged in proximity to the second end opposite from the first end.

In another embodiment of the invention, the two switching elements project into the interior of the protective tube and are fixedly connected to the protective tube.

The two switching elements are preferably part of the protective tube resulting in a structural component part which is very simple to manufacture.

To achieve a convenient operation of the adjusting element, a third switching element is arranged between the first switching element and the second switching element, this third switching element being arranged so as to be axially displaceable at the protective tube and fixable by means of a positioning screw.

A scale is arranged at the outer side of the protective tube to enable a precise adjustment of the third switching element.

The scale is preferably laid out such that it shows the height of the hatch when not fully open or the height of a handle formed in the hatch.

According to one embodiment the invention, the first switching element and the second switching element have the same dimensioning in radial direction, while the third switching element has a smaller radial extension on the inside surface of the protective tube.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings.

Examples of the invention are shown in the drawing and are described more fully in the following.

DETAILED DESCRIPTION OF THE PRESENTLY PREFERRED EMBODIMENTS

Figure 1:
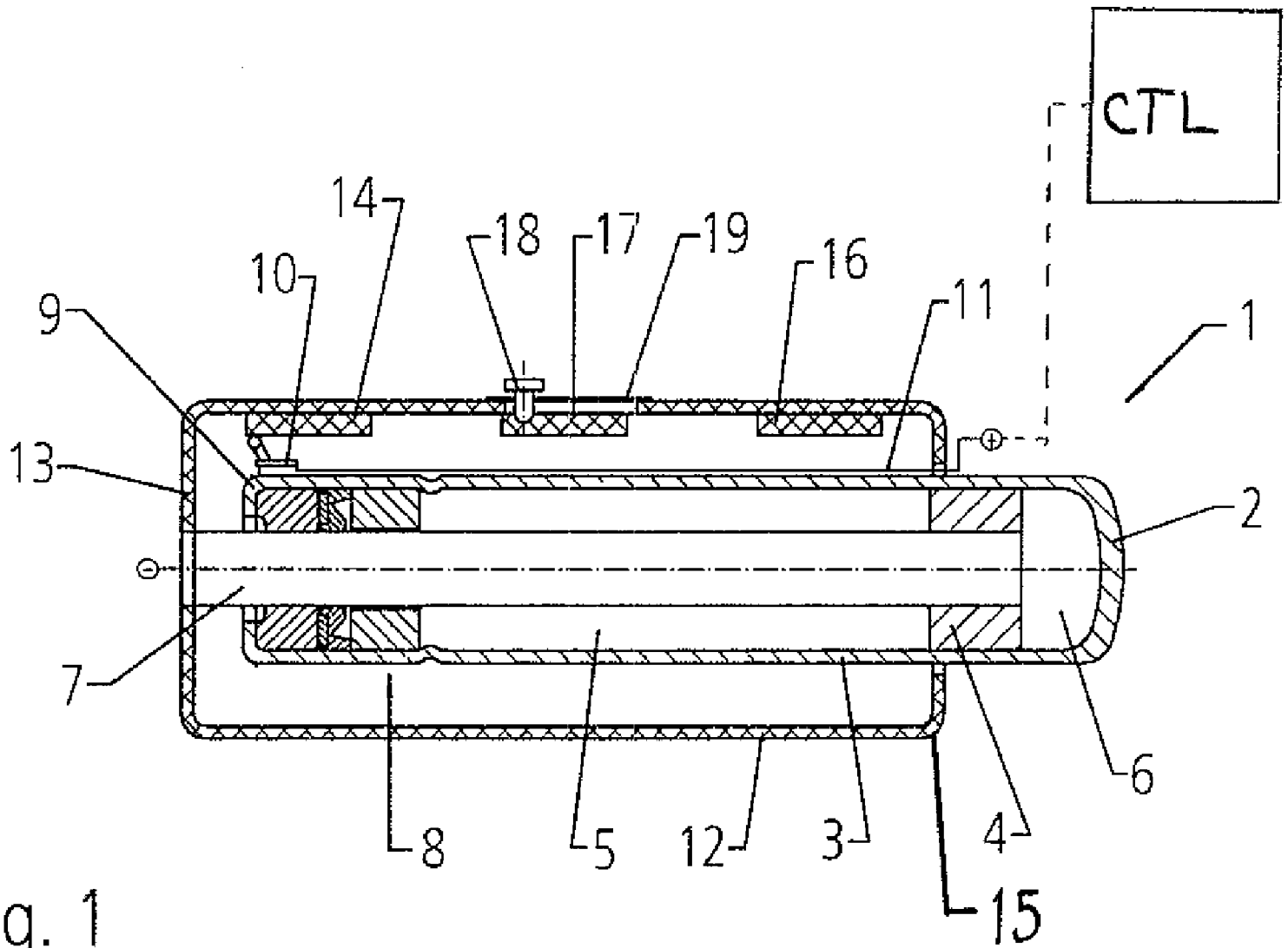
FIG. 1 is a longitudinal section through an adjusting element according to one embodiment of the invention in a first axial position.

FIG. 1 depicts an adjusting element 1 with a hollow cylinder 3 which is closed at a first end 2 and filled with a fluid under pressure. A piston 4 is axially displaceable in the cylinder 3 and divides the cylinder 3 into a first work space 5 and a second work space 6. A piston rod 7 is arranged at one side of the piston 4 and guided out of a second end 9 of the cylinder 3 through the first work space 5 to be sealed by a guiding and sealing device 8. The piston 4 has a magnetic valve, not shown, which can be opened or closed by an electric control to permit or prohibit a flow of fluid through the piston 4. When the magnetic valve is open, fluid is permitted to flow from one work chamber to the other, and the piston 4 and piston rod 7 can move in axial direction in the cylinder 3 along a center longitudinal axis A of the cylinder 3. When the magnetic valve is closed, fluid is prevented from flowing from one work chamber to the other, and the piston 4 is blocked.

Connection devices, not shown, in the form of ball sockets or knuckle eyes, for example, are usually arranged at the first end 2 of the cylinder 3 and at the end opposite from the piston 4.

A switch in the form of a microswitch 10 is connected by at least one line 11, to a power supply device or a control device, not shown, arranged on the outer side of the cylinder 3 near the second end 9.

A protective tube 12 is arranged with a first end 13 at the end of the piston rod 7 located opposite from the piston 4 and with a second end 15 opposite the first end 13. The protective tube 12 is mounted so as to be rotatable relative to the piston rod 7 and, therefore, also relative to the cylinder 3. The protective tube 12 extends in axial direction along the cylinder 3 when the piston 4 is moved in until the first end 2 of the cylinder 3.

A first switching element 14 is arranged at the inner wall of the protective tube 12 in proximity to the first end 3 of the protective tube 12, and a second switching element 16 is arranged in proximity to the second end 15 opposite from the first end 13. The two switching elements 14 and 16 project somewhat into the interior of the protective tube 12 and are fixedly connected to the protective tube 12. The two switching elements 14, 16 are preferably part of the protective tube.

Figure 3:
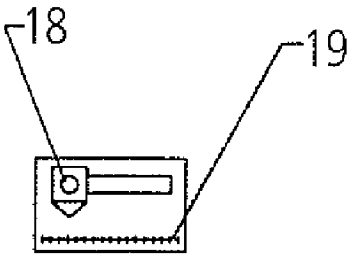
FIG. 3 is a detailed view of a switching element from the adjusting element from FIG. 1.

A third switching element 17 is arranged between the first switching element 14 and the second switching element 16. The third switching element 17 is arranged at the protective tube 12 so as to be axially displaceable and can be fixed by means of a positioning screw 18. A scale 19 can be arranged at the outer side of the protective tube 12 as is shown in FIG. 3 by way of example.

As described above, the outward movement of the gas spring is preferably controlled by a magnetic valve. When electrical energy is supplied to the magnetic valve, it opens resulting in the outward movement of the piston 4 together with the piston rod 7. When the current to the magnetic valve is switched off, the valve closes and the movement is stopped. The object of the microswitch 10 is to switch off the current to the magnetic valve when the microswitch 10 is actuated and to allow current to flow to the magnetic valve when the microswitch 10 is in the inactive state.

The second switching element 16 and the third switching element 17 actuate the microswitch 10 and stop the movement of the gas spring. The first switching element 14 and the second switching element 16 actuate the microswitch 10 substantially in the respective end position of the piston 4, i.e., substantially when the piston 4 is located in proximity to the first end 2 or in proximity to the sealing and guiding device 8.

A length-dependent adjustment of the position of the piston 4 and, therefore, of the open position of a structural component part to be adjusted, for example, a hatch of a vehicle, is accomplished through the variable adjustment of the third switching element 17 by the positioning screw 18.

Figure 4:
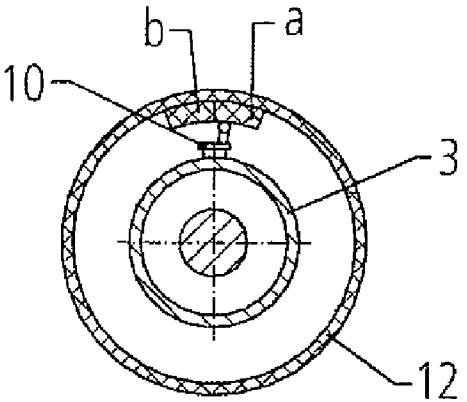
FIG. 4 is a sectional view of the adjusting element.
Figure 5:
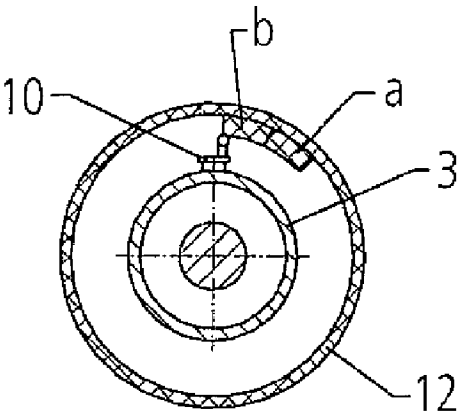
FIG. 5 is another detailed sectional view of the adjusting element shown in FIG. 1.

As can be seen from FIGS. 3, 4 and 5, the user can choose whether the gas spring can open in the length-dependent intermediate position or in the end position by rotating the protective tube 12 into a first switching position a and a second switching position b. The intermediate position is determined by the position of the third switching element 17.

Figure 2:
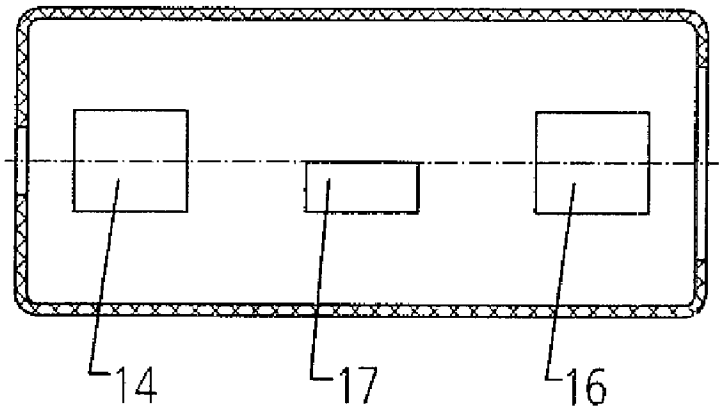
FIG. 2 is a sectional view of the adjusting element shown in FIG. 1.

It can be seen from FIG. 2 that the first switching element 14 and the second switching element 16 have the same dimensioning in a radial direction, while the third switching element 17 has a smaller in the radial direction extension on the inside surface of the protective tube 12. As shown, the switching elements extend circumferentially in protective tube 12.

As shown in FIG. 4, when the first switching position a is selected, the piston rod 7 moves out until the microswitch 10 is actuated by the third switching element 17 as is shown in FIG. 5. The current to the magnetic valve is switched off and the magnetic valve closes the through-flow channels so that the movement of the piston 4 is blocked. The user can decide whether to close the vehicle hatch by manual pressure in closing direction or whether to open the hatch to the end position by pressing in the opening direction.

Figure 6:
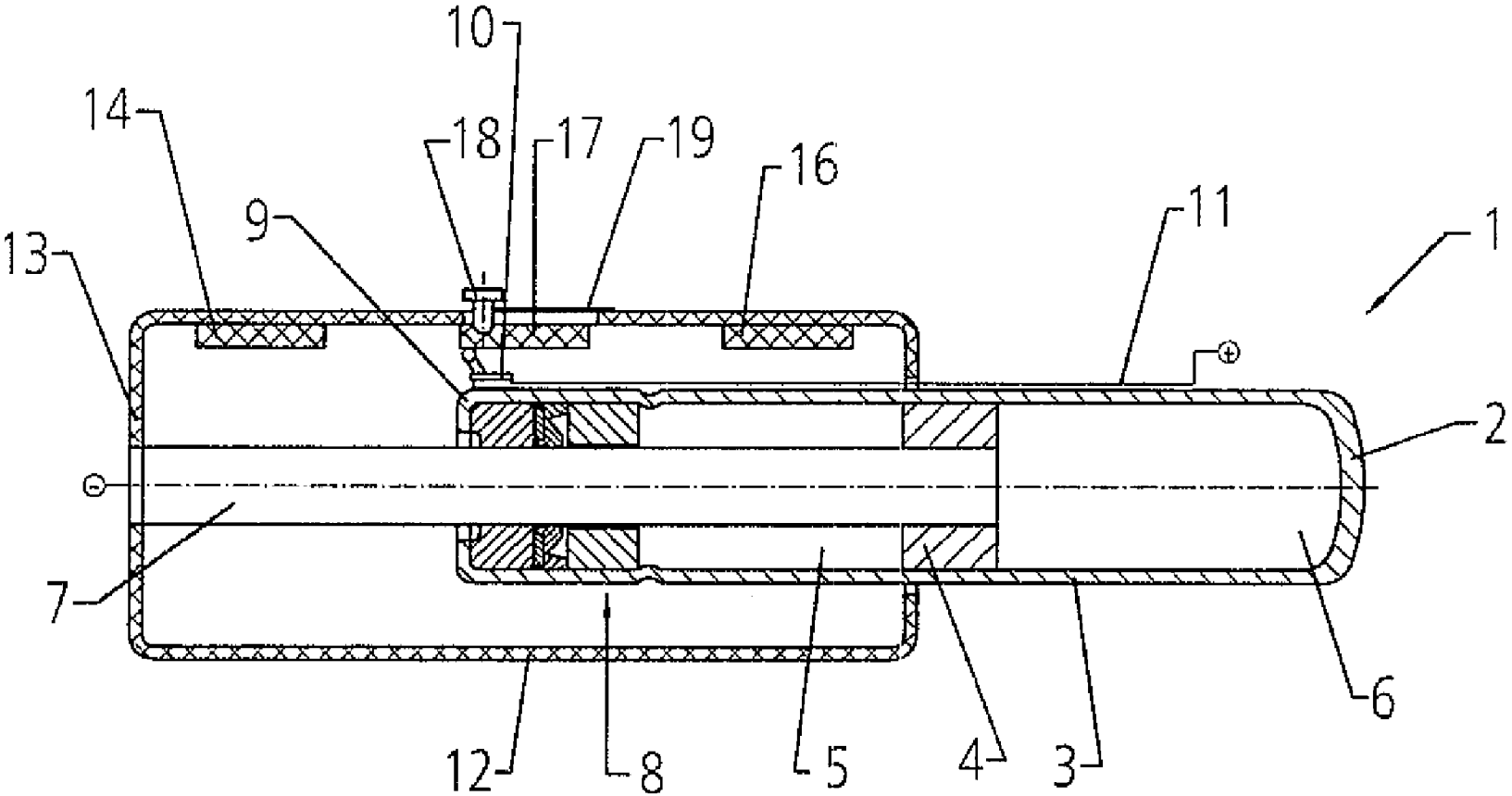
FIG. 6 is a longitudinal sectional view of the adjusting element similar to FIG. 1.
Figure 7:
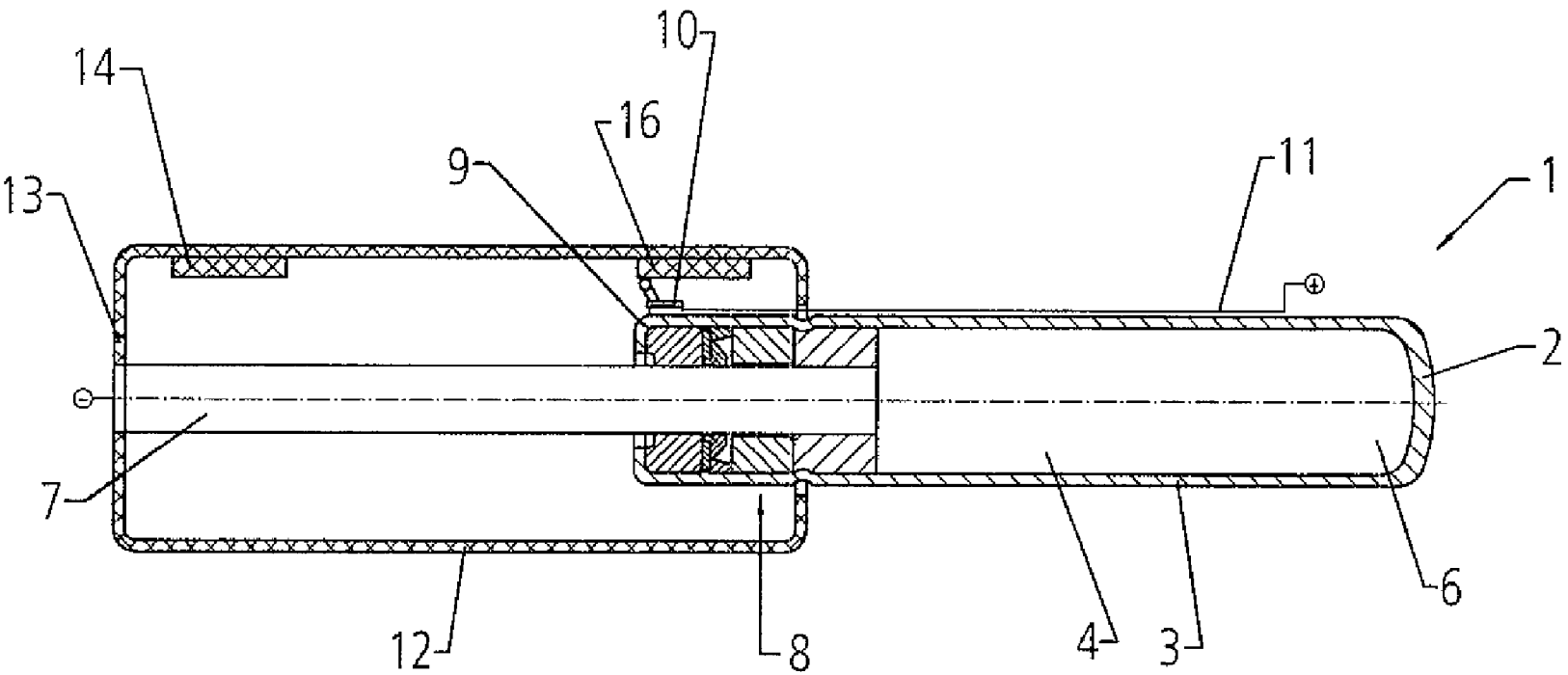
FIG. 7 is a sectional view of the adjusting element similar to FIG. 1.

By rotating the protective tube 12 circumferentially into switching region b, the piston and piston rod 7 move out until the microswitch 10 is actuated by the second switching element 16 as is shown in FIG. 6, which essentially corresponds to an opened position of the hatch.

The first switching element 16 serves to switch off the current to the magnetic valve when the hatch is fully open, that is, when the piston 4 is located in proximity to the first end 2 of the cylinder 3.

The scale 19 is preferably constructed such that it shows the height of the hatch when not fully open or the height of a handle formed in the hatch, so that a direct adjustment is possible by the user. By varying the positioning screw 18 and, therefore, the third switching element 177 the adjusting path of the hatch can be adjusted very precisely and can also be adjusted to the body size of the user.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

I claim:

1. An adjusting element comprising:

a cylinder with a closed first end;

a piston displaceably arranged in the cylinder and configured to divide the cylinder into a first work space remote of the closed first end and a second work space in proximity to the closed first end;

a piston rod arranged at one side of the piston and which projects through the first work space and is guided out of the cylinder concentric to a center longitudinal axis of the cylinder at a second end opposite from the closed first end so as to be sealed by a guiding and sealing device; and a position detecting device configured to detect at least one of a piston rod position and an extended length of the adjusting element, the device for detecting the piston rod position comprises:

at least one microswitch arranged at the cylinder; and at least one switching element configured to activate the microswitch including a first switching element arranged at an inner wall of a protective tube in proximity to a first end of the protective tube;

a second switching element arranged in proximity to a second end of the protective tube opposite the first end of the protective tube; and a third switching element arranged between the first switching element and the second switching element, the third switching element is axially displaceable on the protective tube and configured to be fixed to the protective tube by a positioning screw.

2. The adjusting element according to claim 1, wherein the microswitch is configured to be connected to a power supply device or a control device by at least one line.

3. The adjusting element according to claim 1, further comprising a protective tube arranged coaxially with the cylinder with a first end of the protective tube at the end of the piston rod opposite the piston, the protective tube being rotatably mounted relative to the piston rod and the cylinder.

4. The adjusting element according to claim 1, wherein the two switching elements project into the interior of the protective tube and are fixedly connected to the protective tube.

5. The adjusting element according to claim 4, wherein the two switching elements are part of the protective tube.

6. The adjusting element according to claim 1, further comprising a scale arranged at the outer side of the protective tube indicating a position of the third switching element.

7. The adjusting element according to claim 6, wherein the scale is configured to represent a height of a hatch when not fully open or a height of a handle formed in the hatch.

8. The adjusting element according to claim 1, wherein the first switching element and the second switching element have a same dimension in a circumferential direction on the inside surface of the protective tube and the third switching element has a smaller dimension in the circumferential direction on the inside surface of the protective tube.

* * * * *